US006782712B2

(12) United States Patent
Mikheev et al.

(10) Patent No.: US 6,782,712 B2
(45) Date of Patent: Aug. 31, 2004

(54) REFRIGERATION METHOD AND SYSTEM

(75) Inventors: Vladmir Mikheev, Oxon (GB); Paul Geoffrey Noonan, Oxon (GB); Alvin Jon Adams, Oxfordshire (GB)

(73) Assignee: Oxford Instruments Superconductivity Limited, Oxon (GB)

( * ) Notice: Subject to any disclaimer, the term of this patent is extended or adjusted under 35 U.S.C. 154(b) by 0 days.

(21) Appl. No.: 10/629,852

(22) Filed: Jul. 30, 2003

(65) Prior Publication Data

US 2004/0089017 A1 May 13, 2004

(30) Foreign Application Priority Data

Jul. 30, 2002 (GB) ..... 0217607

(51) Int. Cl.[7] ..... F25B 17/00; F25B 17/08

(52) U.S. Cl. ..... 62/480; 62/106

(58) Field of Search ..... 62/480, 106, 497, 62/148, 112, 238.3, 144, 141, 142

(56) References Cited

U.S. PATENT DOCUMENTS 4,993,239 A * 2/1991 Steidl et al. ..... 62/480
6,502,419 B2 * 1/2003 Pfister et al. ..... 62/497

* cited by examiner

*Primary Examiner*—Chen Wen Jiang

(57) ABSTRACT

An adsorption refrigeration system and method are provided, the system comprising an adsorption pump which, in use, is arranged in communication with a chamber containing liquid and gaseous coolant. The associated method comprises expanding the gaseous coolant into an auxiliary volume member so as to cause the removal of part of the gaseous coolant from the chamber. This causes a reduction in the temperature and pressure of the gaseous coolant in the chamber. The adsorption pump is then operated so as to further cool the chamber by causing the evaporation of the coolant liquid within the chamber.

21 Claims, 8 Drawing Sheets x 10^-3
500.0
480.0
460.0
440.0
K
420.0
400.0
380.0
360.0
118
A
B
31.50
32.00
32.50
33.00
33.50
Time (s) x 10^3

REFRIGERATION METHOD AND SYSTEM

FIELD OF THE INVENTION

The present invention relates to a method of operating an adsorption refrigeration system.

BACKGROUND TO THE INVENTION

Adsorption refrigeration systems are well known in the field of refrigeration and particularly cryogenics, for providing very low temperatures in a region such as a chamber. Adsorption refrigeration systems operate by the provision of an amount of liquid coolant within a chamber to be cooled. This is placed in gaseous communication with an amount of an adsorbing "sorption" material such as charcoal, the entire system being closed such that the amount of coolant within the system remains constant.

Typically the coolant in liquid form is obtained by condensation of gaseous coolant in contact with the cold walls of a member pre-cooled by an external source. This is performed in a conventional adsorption refrigeration system by the use of a "1K pot".

A second, alternative method of obtaining liquid coolant uses an expansion process, in which gaseous coolant is decompressed from a high pressure under adiabatic conditions. This decompression causes liquefaction of the gas thereby generating the liquid coolant. The provision of liquid coolant by this method has been used in an experimental adsorption refrigeration system. However, only a short hold time was achieved in this case with respect to commercial systems having a 1K pot.

The adsorption material of the system is arranged to adsorb the gas above the liquid coolant such that further evaporation of the liquid occurs due to the corresponding reduction in the pressure. The latent heat of evaporation causes a reduction in the temperature of the system.

However, one problem with such adsorption systems is that the sorption material itself can only adsorb a finite amount of gas for a given pressure. Such devices are therefore effectively of the single-shot type, with typical commercial systems being operable for a number of hours, although this is dependent upon the sorption capacity of the sorption material.

Adsorption systems are advantageous in that they are relatively simple devices which can be recharged by simply heating the sorption material so as to cause desorption of the gas-coolant and return it to the gaseous phase. Upon sufficient subsequent cooling, the adsorption material can be reused. As the system is enclosed, there is no loss of coolant and there are no moving parts. This is beneficial in that low temperature experiments can be performed at low levels of vibration for many hours.

The primary problem with conventional adsorption refrigeration systems is the single-shot nature of their operation and therefore, for experiments that require longer periods of operation, conventional adsorption pumps are impractical.

Conventional systems having a 1K pot tend to be expensive due to the provision of the 1K pot and its support systems. In addition, the use of a 1K pot does also produce some vibrations, which it is desirable to eliminate.

In the alternative experimental system described above the expansion of the gaseous coolant was used to generate the liquid phase coolant rather than using a 1K pot. Thus, although the 1K pot was replaced by using the expansion effect, unfortunately the hold time at operational temperatures was significantly reduced.

There is therefore a strong market demand to improve the operational hold time of such devices along with the elimination of vibrations.

SUMMARY OF THE INVENTION

In accordance with the present invention we provide a method of operating an adsorption refrigeration system, the system comprising an adsorption pump which, in use, is arranged in communication with a chamber containing liquid and gaseous coolant, the method comprising:

i) expanding the gaseous coolant into an auxiliary volume member so as to cause the removal of part of the gaseous coolant from the chamber, thereby reducing the temperature and pressure of the gaseous coolant in the chamber; and ii) operating the adsorption pump so as to further cool the chamber by causing the evaporation of the coolant liquid within the chamber.

We have therefore adopted a new approach in improving the performance of single-shot adsorption devices by the use of an expansion process in which gaseous coolant is expanded into an auxiliary volume member. When a gas is allowed to increase its volume under certain conditions (for example adiabatic conditions), the reduction in pressure produced causes a corresponding reduction in the temperature of the gas. We have realised that, in this way, the expansion effect can be used to greater effect in association with the evaporation cooling of a known adsorption system.

This significantly increases the time at which the chamber can be maintained at operational temperatures, which are suitable for activities such as experimentation. Whereas the known experimental expansion process obtained only a short hold time of a few hours at operational temperatures, with the present invention, hold times of 50 hours or more are realisable without the expense and vibration problems associated with conventional systems having a 1K pot. This is due to the use of an auxiliary volume member which allows for a much improved expansion effect. An increased volume of liquid coolant can therefore be generated and a lower starting temperature is also attainable before the conventional evaporation cooling step begins.

The expansion stage of the method may either be performed once in a single step, or in a number of separate sub-steps in a multistage process with, for example, consecutive pressure reductions, in order to further reduce the temperature in the chamber prior to performing step (ii). Typically in this case step (i) further comprises expanding the gaseous coolant separately into a number of additional auxiliary volume members. Prior to the expansion step (i), the quantity of gaseous coolant supplied to the adsorption refrigeration system is preferably in excess of the saturation limit of the adsorbent material within the adsorption pump when operating under normal working conditions.

Prior to step (i), the coolant may be provided either as a gas or a liquid from any suitable source. However, preferably the coolant is provided as a gas from an auxiliary volume member used in step (i).

The auxiliary volume is preferably a static volume provided by a storage reservoir or a second adsorption pump. The auxiliary volume member may be arranged to have a constant geometrical volume or a variable volume. The use of a variable volume member allows the pressure within the chamber to be controlled and therefore the degree of cooling can be controlled accordingly.

In either case, the expansion of the gaseous coolant may be effected by allowing the gas to expand into the auxiliary volume member. This is generally performed using a controllable valve.

Typically the capacity of the auxiliary volume member is greater than the adsorption capacity of the adsorption pump and this ensures that the single-shot operational time is maximised.

Although the adsorption pump may be separated from the chamber using an appropriate valve such that steps (i) and (ii) of the method are separable, typically the adsorption pump remains in communication with the chamber during the steps of providing and/or expanding the cooling gas to and from the chamber respectively. The operational simplicity of the method is therefore improved.

In such a case, prior to step (i) the adsorption pump is cooled to the first temperature such that the adsorption material contained therein adsorbs the gaseous coolant so as to become substantially saturated for pressures higher than the ultimate pressure obtained at the lowest temperature. Preferably the adsorption pump is then disconnected from the storage vessel and heated so as to desorb gaseous coolant and thereby increase the gas pressure in the chamber. This increase in pressure may be in addition to a positive pressure of gas provided when the gaseous coolant is initially supplied to the chamber prior to step (i).

Typically the adsorption pump is also heated during step (i) so as to maximise the effect of the first stage expansion to the auxiliary volume member.

Following the expansion step (i), the adsorption system is typically isolated from the auxiliary volume member during the subsequent step (ii) so as to maximise the single-shot operational time.

Advantageously in some cases the expansion effect may also be used when the adsorption pump system is no longer in communication with the auxiliary volume member. This may be achieved by cooling the adsorption pump prior to step (ii), thereby further reducing the pressure of the gaseous coolant within the chamber. This effectively expands the gaseous coolant further and causes further cooling in a second expansion step. It was an analogous step of this kind, using only the internal volume of an adsorption pump system, that was used in the known experimental expansion cooling method (described earlier) to generate all of the liquid coolant.

In contrast, the present invention preferably uses this additional expansion process and/or that of step (i) to cause the partial liquefaction of the gaseous coolant.

The method can be used with many known coolants such as helium-4, nitrogen, neon or hydrogen although it is particularly suitable for use with helium-3 as this provides the capability of attaining the lowest temperatures for experimental purposes.

BRIEF DESCRIPTION OF THE DRAWINGS

Some examples of a refrigeration method according to the present invention will be now be described with reference to the accompanying drawings, in which.

DETAILED DESCRIPTION OF THE PREFERRED EMBODIMENTS

Figure 1:
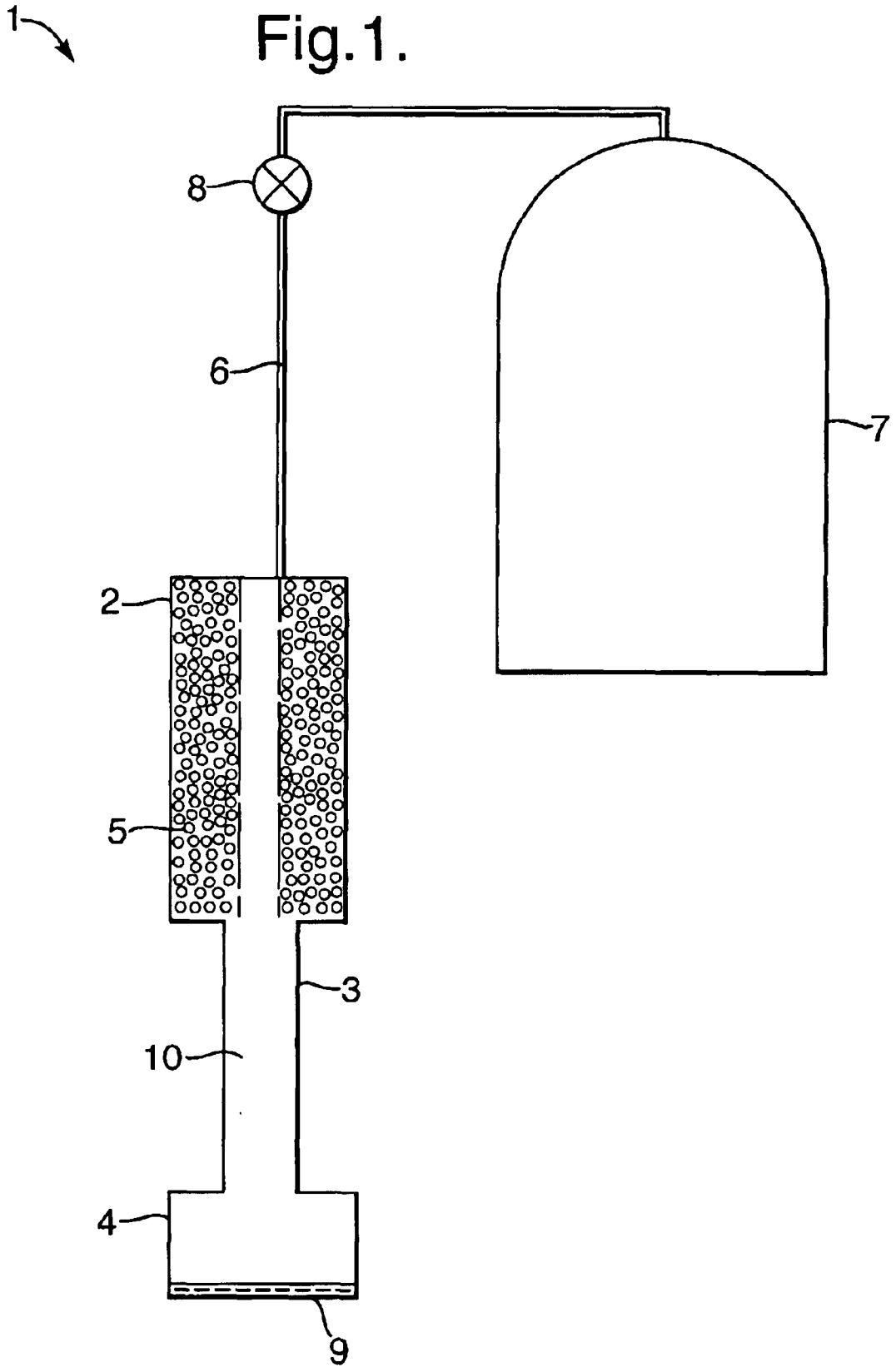
FIG. 1 is a schematic illustration of a refrigeration system according to a first example.

An example of a refrigeration system for use in accordance with the invention is generally indicated at 1 in FIG. 1. An adsorption pump 2 is provided in the form of a chamber connected via a pumping line 3 to a pot 4. The adsorption pump 2 contains an adsorbing material which in this case is charcoal, indicated at 5. The adsorption pump 2, pumping line 3 and the pot 4 are conventional components of a single-shot adsorption refrigeration system. In the present example helium-3 is the coolant liquid/gas.

In a conventional system, these components form a closed system in which gaseous coolant 10 within the volume of the pumping line and pot is adsorbed by the charcoal 5 such that liquid coolant 9 in the bottom of the pot 4 is progressively evaporated causing the pot 4 to cool.

In the present case, however, the internal volume of the adsorption pump 2, pumping line 3 and pot 4 is connected via a pipe 6 to an auxiliary volume member 7 in the form of a reservoir such as a gas storage vessel. A valve 8 within the pipe is selectively operable by a user so as to allow or prevent communication of gaseous coolant 10 (helium-3) between the reservoir 7 and the remainder of the system.

For the purposes of this example, the charcoal 5 is capable of adsorbing about four litres of coolant gas, the reservoir 7 having a volume of about ten litres.

Figure 2:
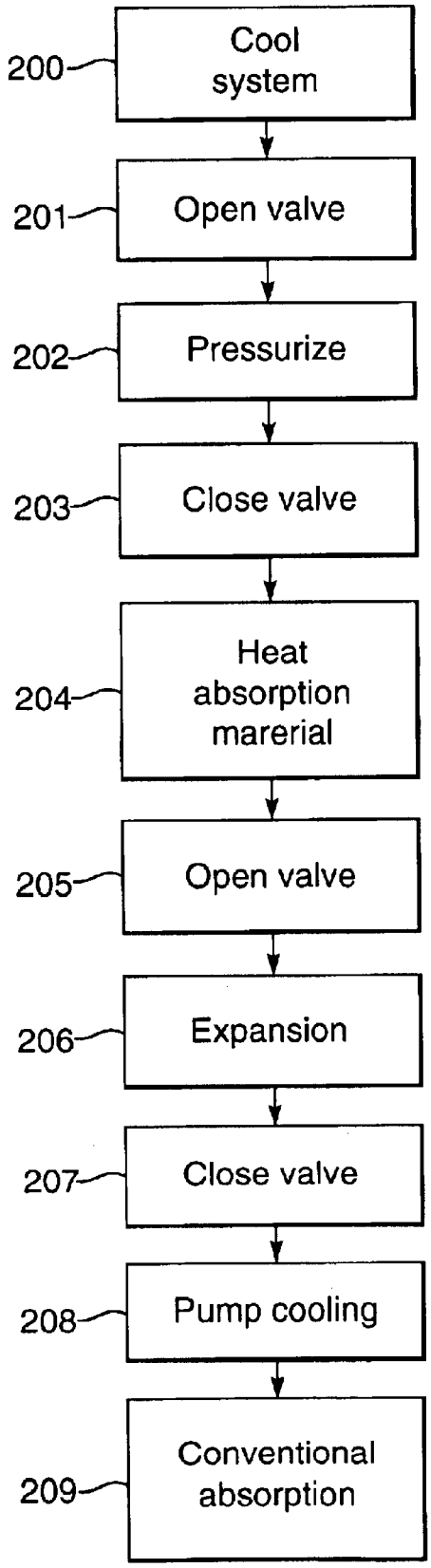
FIG. 2 is a flow diagram of the method according to the first example.

FIG. 2 is a flow diagram of a method of operating the apparatus of FIG. 1. At step 200, the refrigeration system indicated at 1, other than the storage reservoir 7 is cooled by conventional means such as a helium-4 cryostat to about 4K. Prior to this operation, an amount of helium-3 is provided as a gas to the adsorption pump 2, pumping line 3 and pot 4. At this stage there is no liquid coolant within the pot 5 and the valve 8 is closed.

At step 201, when the system has been cooled to the cryostat temperature of 4K, the valve 8 is opened and the helium-3 coolant gas passes from the reservoir 7, due to its higher pressure, into the adsorption pump 2, pumping line 3 and pot 4. It should be noted that during this step, the charcoal 5 becomes saturated with helium-3 and the pressurising continues until a positive pressure of, for example, about 0.5 Bar (absolute pressure) is attained and the relative pressure between the adsorption pump system and reservoir has been reduced. The use of an absolute pressure lower than that of atmospheric pressure prevents the loss of the relatively expensive helium-3 through leaks to the surrounding environment. The valve 8 can be operated for a sufficient time to equalise the pressure between the adsorption pump system and the reservoir if necessary.

Following pressurisation at step 202, the valve 8 is closed at step 203 and the charcoal 5 in the adsorption pump is then heated at step 104 to a temperature of about 100 K. This heating causes the desorption of the helium-3 coolant 10 from the charcoal 5 and therefore causes a further increase in the gas pressure within the system, typically up to 10 Bar. During this step, the pot is maintained at a low temperature, for example at 4K.

Once the desorption is complete, the pressure within the adsorption pump system and the pot 4 is higher than prior to heating due to the desorption of the helium-3 from the charcoal 5.

At step 205, the valve 8 is then opened. This causes the expansion of the gas at step 206 as the gas flows so as to equalise the pressure between the two systems. Therefore, the gas within the adsorption pump system expands into the additional volume provided by the reservoir 7. The magnitude of the expansion depends upon the volume of the reservoir 7 and the pressure of the gas within the reservoir prior to the valve 8 being opened. This expansion causes the partial liquefaction of the coolant gas and, unlike in conventional adsorption refrigeration systems where a "1K pot" is used to provide the liquid helium-3, here the helium-3 is conveniently produced by the expansion process itself.

If it is not sufficient to use the same reservoir 7 for initial delivery of the gaseous coolant and to act as an auxiliary volume member, then two or more separate reservoirs could be used in series, to provide a higher saturation pressure for the adsorption pump.

Although the charcoal 5 is maintained at the elevated temperature (for example 100K) during this stage, the expansion of the helium-3 coolant gas causes a significant reduction in the temperature within the pot 4 (in this example by about 2.8K). This is a sufficiently low temperature for helium-3 to exist in the liquid phase. Partial liquefaction of some of the coolant gas within the system therefore occurs due to the expansion and this liquid helium-3 collects in the pot 4.

Ideally the reduction in the pressure is as large as possible and in this case, on completion of the expansion, the gas pressure is similar to the lowest pressure attained having completed cooling the system at step 202. As mentioned earlier, when using the reservoir 7, this pressure would be the final equalised gas pressure for the volume and adsorption refrigerator, (generally below 1 atmosphere to minimize leaks).

Returning to FIG. 2, once the pressure has equalized between the adsorption system and the reservoir 7, the valve 8 is then closed at step 207 to isolate the adsorption pump 2, pumping line 3 and pot 4. The adsorption pump is then cooled at step 208.

During step 208 as the adsorption pump cools from 100K to about 20K, a second expansion effect occurs due to the pressure reduction of the gas in the vicinity of the pump. It should be remembered that the pot 4 at this stage is at the low temperature produced by the earlier expansion process. Therefore, the coolant gas in the pot 4 is caused to effectively expand by the pressure reduction and this causes further cooling within the pot 4 and further liquefaction of the helium-3.

At step 209, the adsorption pump begins to operate in a conventional manner as it is cooled below about 20K. As the gaseous coolant is adsorbed, evaporation of the liquified helium-3 in the pot 4 occurs and this process continues such that a temperature of about 0.3K is attained for many hours.

The pre-cooling caused by the expansion of the coolant gas into the storage reservoir 7 therefore provides a lower starting temperature for the conventional operation of the adsorption system. This in turn produces a significant increase in the single-shot operational time and particularly in the case of helium-3 where the ordinary single-shot time is increased from between 5 and 6 hours to between 20 and 50 hours.

Rather than using a single auxiliary volume member, it will be appreciated that the cooling by the initial expansion effect can also be achieved by expanding the gas separately into a number of separate auxiliary volume members. This can be performed in a number of steps so as to maximize the gas expansion effect.

Figure 3:
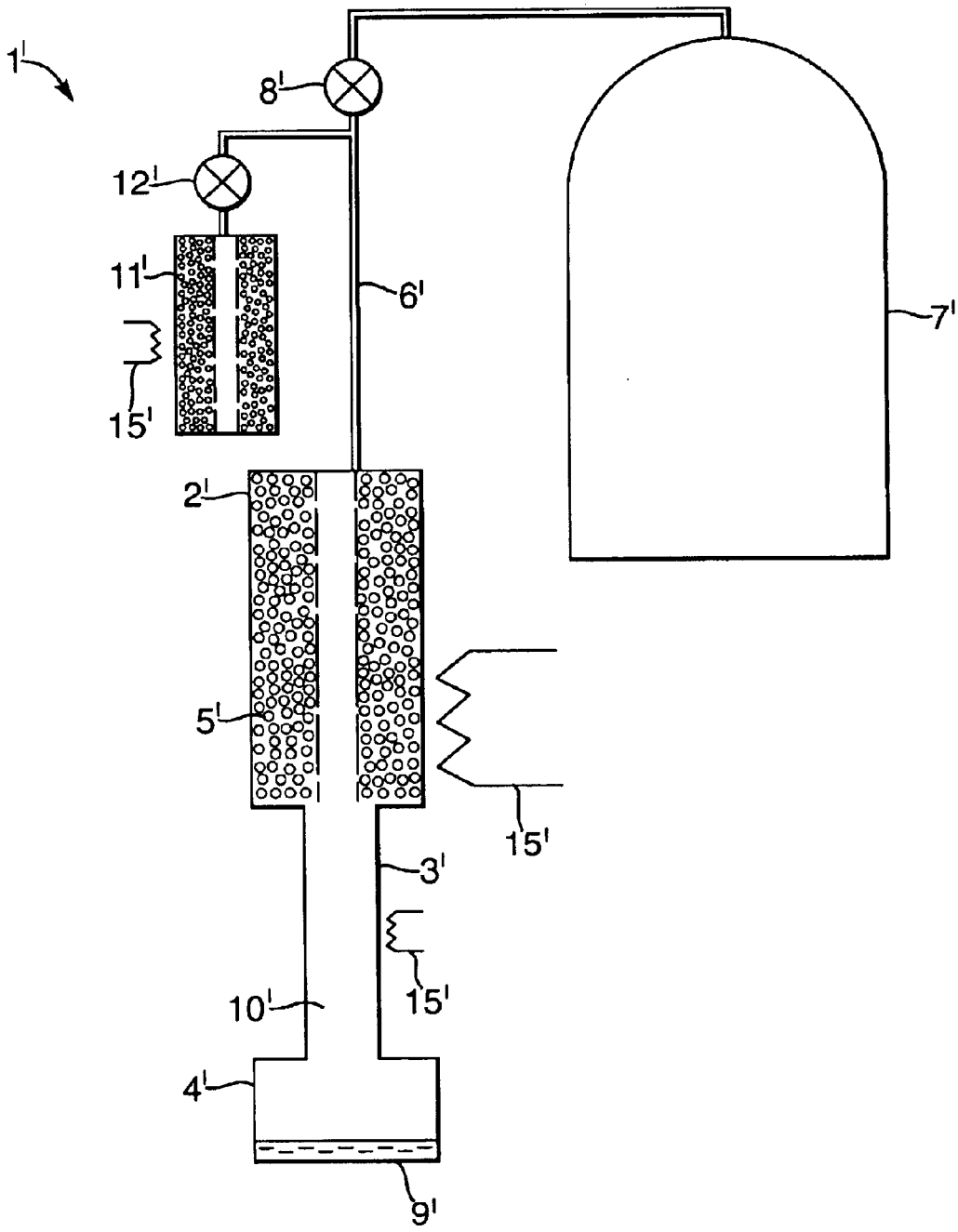
FIG. 3 shows a second example system.

FIG. 3 shows a second example of apparatus for performing the method. Here, similar apparatus to that of FIG. 1 is denoted by primed reference numerals of similar value. In this case, the storage reservoir 7' is only used to add the coolant under pressure to the adsorption system at step 202. Three cooling loops 15' are also indicated in FIG. 3.

A second adsorption pump 11' is provided to act as the volume into which the gaseous coolant 10 expands during step 205 under the control of a second valve 12'. In this alternative system, the method of FIG. 2 is modified slightly. Following the heating of the adsorption pump at step 204, the valve 8' remains closed and the second valve 12' is opened which again causes a reduction of the coolant gas pressure within the adsorption system.

Unlike the main adsorption pump 2', during this step the adsorption pump 11' is cooled so as to maximise the adsorption of the gaseous coolant 10, thereby reducing its pressure and causing a corresponding drop in temperature. Once sufficient cooling has been achieved or saturation of the adsorption pump 10' has been reached, the valve 12' is closed at step 207, again isolating the main adsorption system and allowing it to be operated in a conventional manner at step 209.

As a further modification to the apparatus and methods described herein, the temperature of the additional volume (s) such as the storage reservoir 7 of FIG. 1, can be controlled in a variable manner during the performance of the method so as to enhance the cooling function.

Some further examples of apparatus for performing the method according to the invention are now described. These each involve the use of a "heat pipe" to act as a thermal diode and increase the operational performance of the refrigeration system.

A third example of refrigeration apparatus comprises:

a sealed chamber containing coolant and having an upper region and a lower region, the upper and lower regions being arranged in communication with one another; and an adsorption refrigeration system as described above in association with any of the earlier examples. The adsorption refrigeration system is here arranged to cool the upper region with respect to the lower region of the sealed chamber.

Under working conditions, the chamber is at least partially filled with coolant gas, so that when the upper region is cooled with respect to the lower region, the coolant gas is caused to condense into coolant liquid in the upper region, the coolant liquid then moving, under gravity, into the lower region such that the lower region is cooled.

In contrast to known methods in which target apparatus to be cooled is placed directly adjacent the lowest temperature region of the refrigeration system, we have realised that by also incorporating a sealed chamber containing a coolant, it is possible to maintain the desired low temperature in a region spatially displaced from the refrigeration system.

This is achieved by providing a fast transport of low temperature coolant liquid at the desired low temperature from the upper region to the lower region. By placing the apparatus to be cooled in contact with the lower region rather than the upper region, improved temperature stability is attained. This is because the intermediate cooling process (provided by the condensing coolant) dampens any temperature instability within the refrigeration system. The poor thermal conductivity of the vapour helps to break the link between the upper and lower regions. Known apparatus arrangements attempt to make good thermal contact with the refrigeration system and therefore are exposed to any instability within them.

Particular advantage is provided with single-shot adsorption refrigerators, in that the apparatus described effectively acts as a heat diode. However, "the heat pipe" described here could be used with other forms of refrigeration systems.

Under working conditions, when the coolant gas is condensed by the adsorption refrigeration system, this cooling is very quickly and effectively applied to the lower region by the physical passing of the liquid from the upper region to the lower region rapidly.

However, in the reverse direction, should the upper region increase in temperature with respect to the lower region, then the main mechanisms by which the heat may transfer between the two regions is via conduction within the walls of the chamber or through the vapour. This reverse heat transfer can be reduced by minimising the conductivity of the chamber walls, thereby increasing the thermal isolation of the lower region.

This is particularly advantageous with single-shot adsorption refrigeration systems as a thermal barrier is provided between the apparatus to be cooled and the refrigeration system. As the lower region accordingly rises in temperature much more slowly than the upper region, the speed at which the lower region may be returned to the ultra-low temperature desired is significantly increased.

Preferably therefore the upper and lower regions are arranged to be spatially separated by an elongate intermediate region as this increases the thermal barrier between the two regions in the reverse direction. Although either of the upper or lower regions may be of similar form and cross-section as the intermediate region, preferably at least one of the upper and lower regions is arranged as a sub-chamber, having a diameter in excess of that of the intermediate region.

The coolant used depends upon the application and in particular upon the working temperature desired to be attained and typically will be a similar coolant to that used in the adsorption refrigeration system. Typically these coolants are capable of evaporation and condensation at the approximate working pressures and temperatures involved. As mentioned earlier, suitable coolants include nitrogen, helium-4, neon, hydrogen and, for ultra-low temperatures, helium-3. Mixtures of two or more of these coolants can also be used.

The apparatus desired to be cooled preferably further comprises a cold platform arranged in thermal contact with the lower region for use in mounting further devices or further apparatus to be cooled, such as experimental devices or the still of a dilution refrigerator.

As a further advantage of the apparatus of this third example, the temperature stability and the thermal barrier effect can be used in producing a "quasi-continuous" cooling system. At least two sets of cryogenic cooling apparatus according to the third example can be provided with a common cold platform arranged in thermal contact with each lower region of the sealed chambers of the apparatus. An example of this is described below in the fifth example where each single-shot refrigeration system is arranged such that the common cold platform is continuously cooled by at least one of the sets of refrigeration systems.

Each set of the refrigeration systems may have their own individual lower regions in contact with the cold platform although preferably they share a common lower region of their chambers, such that the coolant may pass between the chambers of the sets of apparatus.

A variety of experimental apparatus may be mounted to the cold platform, although one alternative use of the system is in cooling part of a dilution refrigeration device to provide continuous dilution refrigeration as is illustrated below in the sixth example.

Typically in this case, the system further comprises a dilution refrigeration device having a still, wherein the still is in thermal contact with each lower region of the sealed chambers of the refrigeration apparatus. In this case the upper part of the still is preferably cooled such that the distillate vapour is condensed into a distillate liquid and passed to the mixing chamber of the dilution refrigerator.

This apparatus may be preferably used in cooling the upper part of a still to around 0.4 kelvin thus enabling the continuous operation of the dilution refrigerator. The coldest temperature in such a system, as in other dilution refrigerators, is attained in the mixing chamber.

Figure 4:
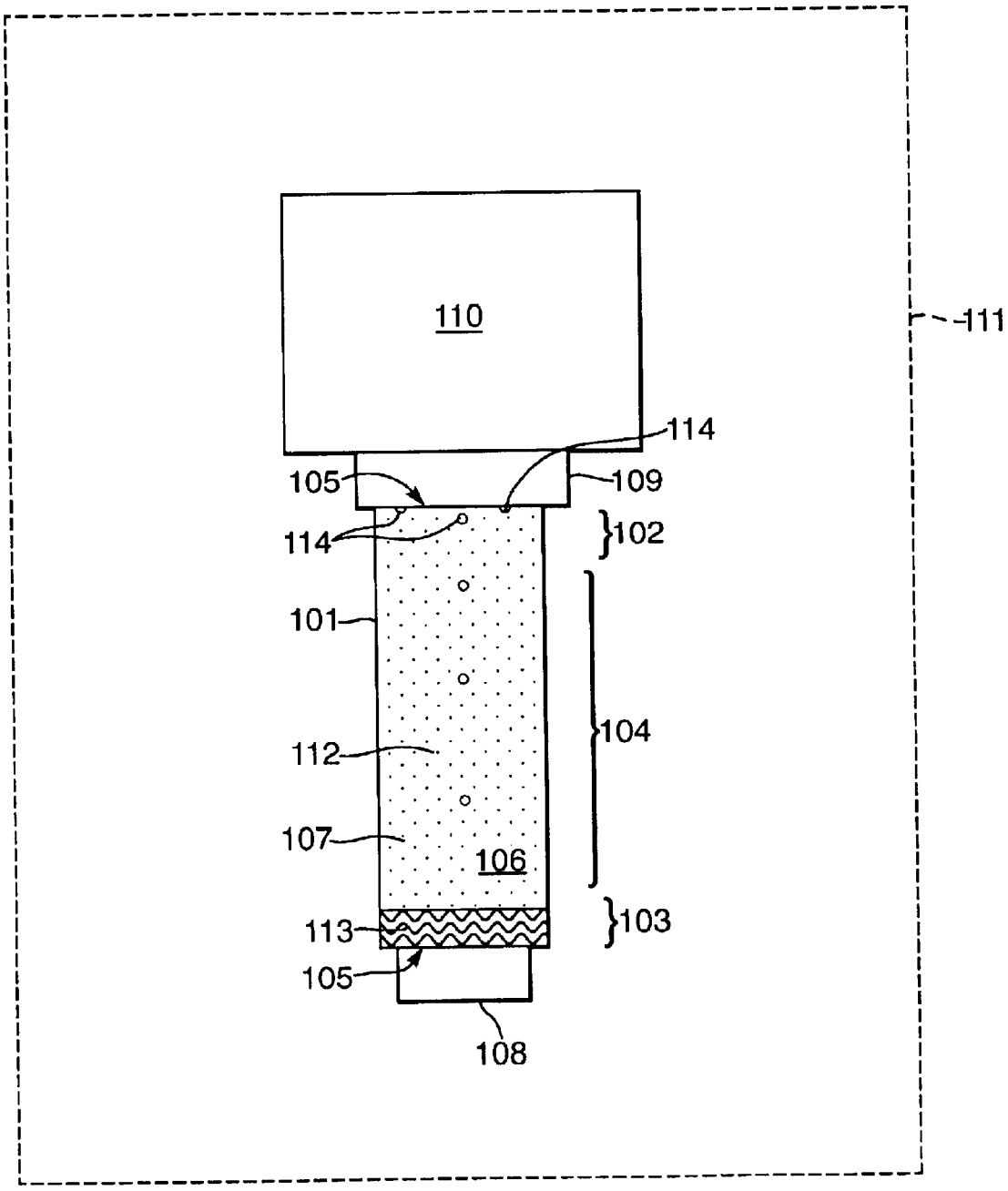
FIG. 4 is a schematic representation of a third example system having a heat pipe.

Turning now to specific examples of these "heat pipe" systems, FIG. 4 is a schematic representation of the third example of the invention. A heat pipe 101 is provided in the form of an elongate hollow cylinder fabricated from a suitable cryogenic alloy such as stainless steel. The heat pipe 101 is vertically orientated and has an upper region 102 and a lower region 103 as indicated in FIG. 4. An intermediate region 104 separates the upper 102 and lower 103 regions. The heat pipe 101 is of circular cross-section and is sealed at the ends of the upper region 102 and lower region 103 by end plates 105. These are formed for example from stainless steel disks having a similar cross-section to that of the cylinder. The heat pipe 101 is therefore enclosed by the end plates 105 to form a sealed chamber 106.

Prior to sealing, an amount of coolant such as helium is added to the chamber, the coolant having a boiling point appropriate for the application under working conditions. As in general the coolant is added when the heat pipe is at temperatures above the operating temperature, coolant is normally added as a gas to the chamber 106 prior to the chamber being sealed.

The lower region 103 is placed in thermal contact with apparatus generally indicated at 108, for example by attaching the apparatus 108 to the end plate 105 of the lower region 103. The apparatus 108 generally represents equipment or devices desired to be cooled and examples of these include experimental apparatus and indeed certain components in other refrigeration systems, as will be described later.

The upper region 102 of the heat pipe 101 is placed in thermal contact with a refrigerated component 109 which in turn is refrigerated by an adsorption refrigeration system 110, examples of which have been described above with reference to FIGS. 1 and 3.

In conventional systems, the apparatus 108 would be provided in good thermal contact with the refrigerated component 109. However, in the present example the heat pipe 101 is placed between these components and this serves to increase the time period during which the apparatus 108 can be maintained at a desired low temperature.

Under normal operating conditions, the amount and type of coolant 107 is chosen such that an amount of coolant vapour 112 is present within the heat pipe when the refrigeration system 110 is operated to begin refrigerating the component 109. Some of the coolant 107 may also be present in the liquid phase as coolant liquid 113 positioned in the lower region 103 at the beginning of this operation. This will depend upon the pressure and temperature within the sealed chamber 106.

As refrigeration of the refrigerator component 109 begins, the temperature of the end plate 105 in the upper region 102 is reduced with respect to the vapour 112 inside the chamber 106. This causes the condensation of the vapour on the surface of the upper end plate 105 within the chamber 106. As condensation continues, a number of droplets 114 begin to form on the inner surface of the end plate 105 in the upper region. As the nucleation and growth of these droplets continues, they eventually detach from the end plate 105 and fall due to gravity into the lower region 103.

The temperature of the droplets is substantially the same as that of the refrigerated component 109 and the gradual accumulation of the coolant 107 droplets in the lower region 103 causes that lower region 103 to attain a temperature close to that of the refrigerated component 109, such as 0.30±02K. In turn, the apparatus 108 is cooled by a thermal contact with this region 103 through the lower end plate 105.

The condensation of the vapour serves to reduce its pressure which encourages further evaporation from the surface of the coolant liquid 113 gathered in the lower region 103. The rapid movement of the droplets 114 from the upper region 102 to the lower region 103 ensures that the apparatus 108 is cooled to a similar temperature as that of the refrigerator component 109.

Single-shot adsorption refrigerator systems such as those represented by 110 are not capable of continuous operation. Therefore single-shot cooling is provided for a limited period and should this period be insufficient for the purposes of using the apparatus 108, then this process must be restarted after a period in which the refrigeration system 110 is regenerated. Such a regeneration period is often lengthy and this causes the apparatus 108 to rise in temperature.

In the present example, the heat pipe 101 effectively operates as a heat diode in which, when the refrigerator component 109 is at a low temperature with respect to the apparatus 108, the cooling of the apparatus 108 is rapid due to the action of the falling droplets 114.

However, when the refrigerator component 109 is no longer cool with respect to the coolant vapour 112, the elongate shape of the heat pipe 101 and the presence of the vapour 112 provide a thermal barrier between the upper 102 and lower 103 regions of the heat pipe 101 and therefore also between the refrigerator component 109 and the apparatus 108.

The rise in temperature of the apparatus 108 is therefore significantly slower than that of the refrigerated component 109 and this allows experiments to continue in some cases after the refrigeration system 110 has ceased to function. In addition, this means that upon attempting to cool the apparatus 108 again at a later time following regeneration of refrigeration system 110, the apparatus 108 is already at a temperature much closer to the desired low temperature suitable for operation of the apparatus 108.

Figure 5:
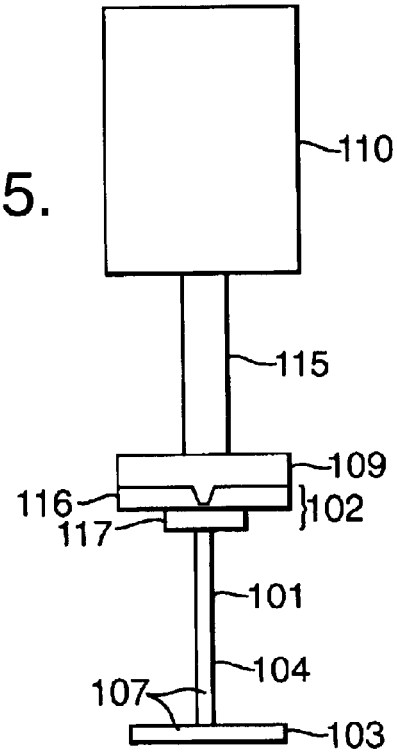
FIG. 5 is an illustration of a fourth example.

A fourth example is shown in FIG. 5. Here similar components are given similar reference numerals as in FIG. 4.

The upper region 102 of the heat pipe 101 is provided as two connected sub-chambers 116,117, the upper sub-chamber 116 being in direct thermal contact with the evaporation chamber 109 and is of similar diameter, whereas the second sub-chamber 117 below the upper 116 is of a reduced diameter. Beneath this, the intermediate region 104 of the heat pipe 101 is again of narrower diameter than that of the lower sub-chamber 117 and this in turn is connected to a sub-chamber forming the lower region 103 having again a larger diameter.

The intermediate region 104 of the heat pipe 101 is, for example, 3 mm in diameter with a length of 100 mm. Again the heat pipe 101 is formed from a suitable stainless steel, the top volume of which in the combined sub-chambers 116 and 117 is about 0.5 $cm^3$ with a similar volume forming the chamber of the lower region 103.

The coolant 107 in this example is helium-3 and a typical volume of helium-3 used in this case is 200 $cm^3$ at standard temperature and pressure. This equates to approximately 0.3 $cm^3$ of liquid under working conditions.

In this fourth example, the heat pipe 101 operates in a similar manner as that described in the third example using the helium-3 to cool the apparatus 108 (not shown in FIG. 5).

Using the apparatus schematically shown in FIG. 5, following an initial cooling stage taking approximately 20 minutes, a temperature of approximately 0.36 kelvin has been maintained for up to 10 hours with a temperature stability of around 1 millikelvin. This indicates that the heat pipe 101 can effectively cool the apparatus 108 to the low temperature desired and maintain this with a great degree of temperature stability for a number of hours. During a desorption procedure which takes about 20 minutes, the thermal barrier effect of the heat pipe ensures that the temperature of the lower region only increases by about 0.5 Kelvin.

Figure 6:
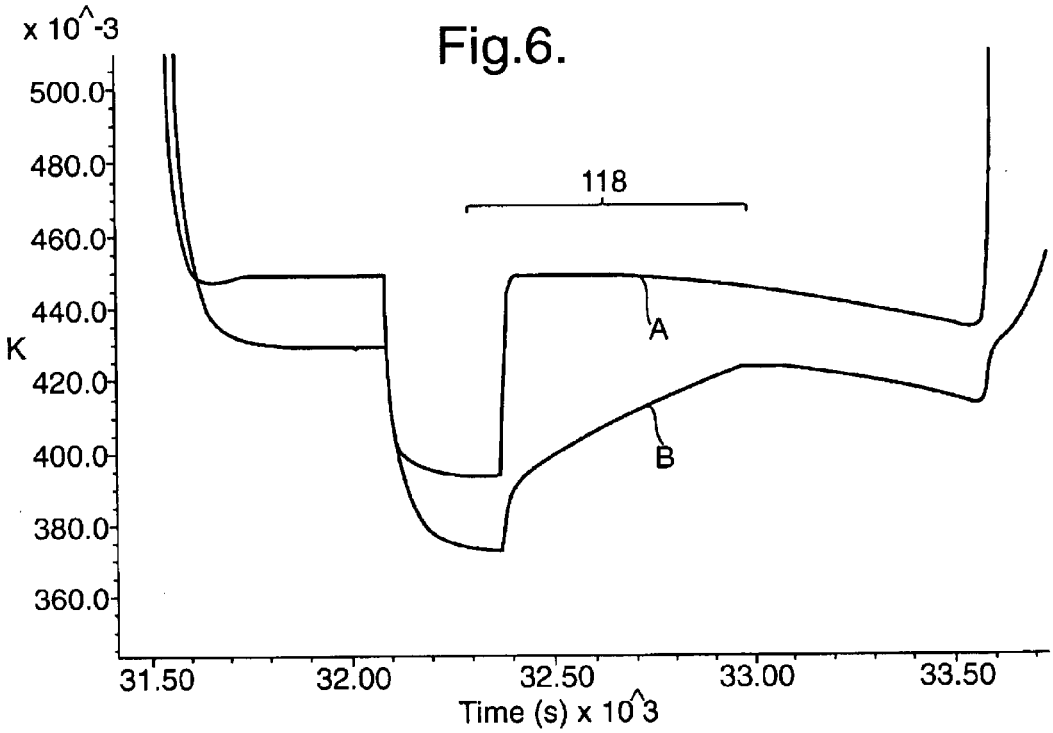
FIG. 6 is a graph of experimental data measured in accordance with the third example.

Some experimental data relating to the heat pipe of this fourth example are presented in FIG. 6 in the form of a graph of temperature (in Kelvin) against time (seconds×1000). Temperature data are plotted in FIG. 6 as two traces A, B. The trace A represents the temperature measured at the evaporation chamber 109 within FIG. 5, whereas the trace B represents the temperature measured within the apparatus 108 in thermal contact with the lower region 103.

It should be noted that the traces A and B have been shifted in temperature (ordinate) with respect to one another and therefore these temperatures do not represent absolute values with respect to one another or with respect to the temperature scale. However, each trace A,B represents relative changes in measured temperature. The region of interest regarding the temperature response of the system is broadly indicated at 118. The parts of the traces A,B outside this region merely show various test responses.

Within the region 118 of FIG. 6, a rise in temperature of approximately 60 millikelvin is deliberately caused in the region of the evaporation chamber 109. In trace A, the measured increase in temperature can be seen to be very rapid and take a matter of only a few seconds. However, a response to the temperature rise in trace B is shown to be much slower, representing the thermal barrier that the heat pipe 101 provides upon the heating of the evaporation chamber 109. The initial rapid rise in trace B is caused by dew evaporation.

It can also be seen that the lower region of the heat pipe only attains this approximate 60 millikelvin increase in temperature over a period of about 10 minutes.

Figure 7:
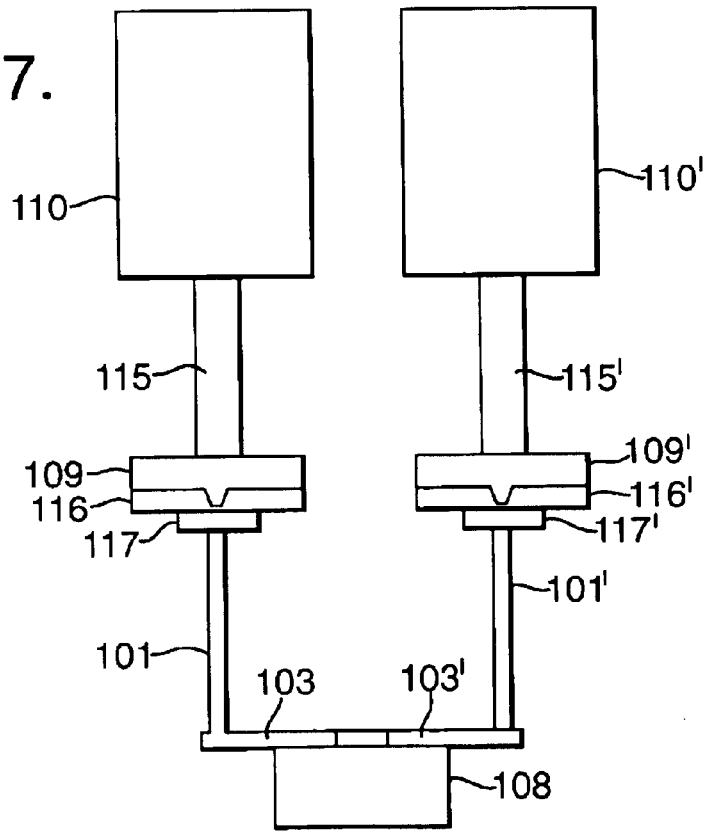
FIG. 7 is an example of a quasi-continuous refrigeration system in accordance with a fifth example.

A fifth example of the invention is shown in FIG. 7 in which two identical sets of refrigeration apparatus (as described in connection with FIG. 5) are used in parallel to cool a common set of apparatus 108. Each of these only differs from the system described in FIG. 5 by a lateral displacement of the lower region 103 of the heat pipe 101. The corresponding reference numerals of the second set of refrigeration apparatus are denoted with similar numerals with the addition of a "'".

By using two single-shot adsorption refrigeration systems 110,110', and two corresponding heat pipes 101,101' a quasi-continuous cooling offset effect can be achieved in the apparatus 108. As the time required for desorbing either of the adsorption refrigeration systems 110,110' is significantly less than a single-shot operation period, whilst one system is cooling the apparatus 108, the other may be desorbed. The corresponding heat pipe attached to the adsorption refrigeration system 110,110' during desorbing prevents this from heating the apparatus 108 significantly.

A slight reduction in the single-shot operation time may result, although the desired low temperature within the apparatus 108 is maintained permanently by the repeated switching of each of the refrigeration devices 110,110' into adsorption and desorption modes.

In FIG. 7, the heat pipes 101,101' each have separate lower regions 103,103' although these can be joined to form a common lower region and therefore a single sealed chamber. This may provide greater extensive cooling over a larger surface area.

Figure 8:
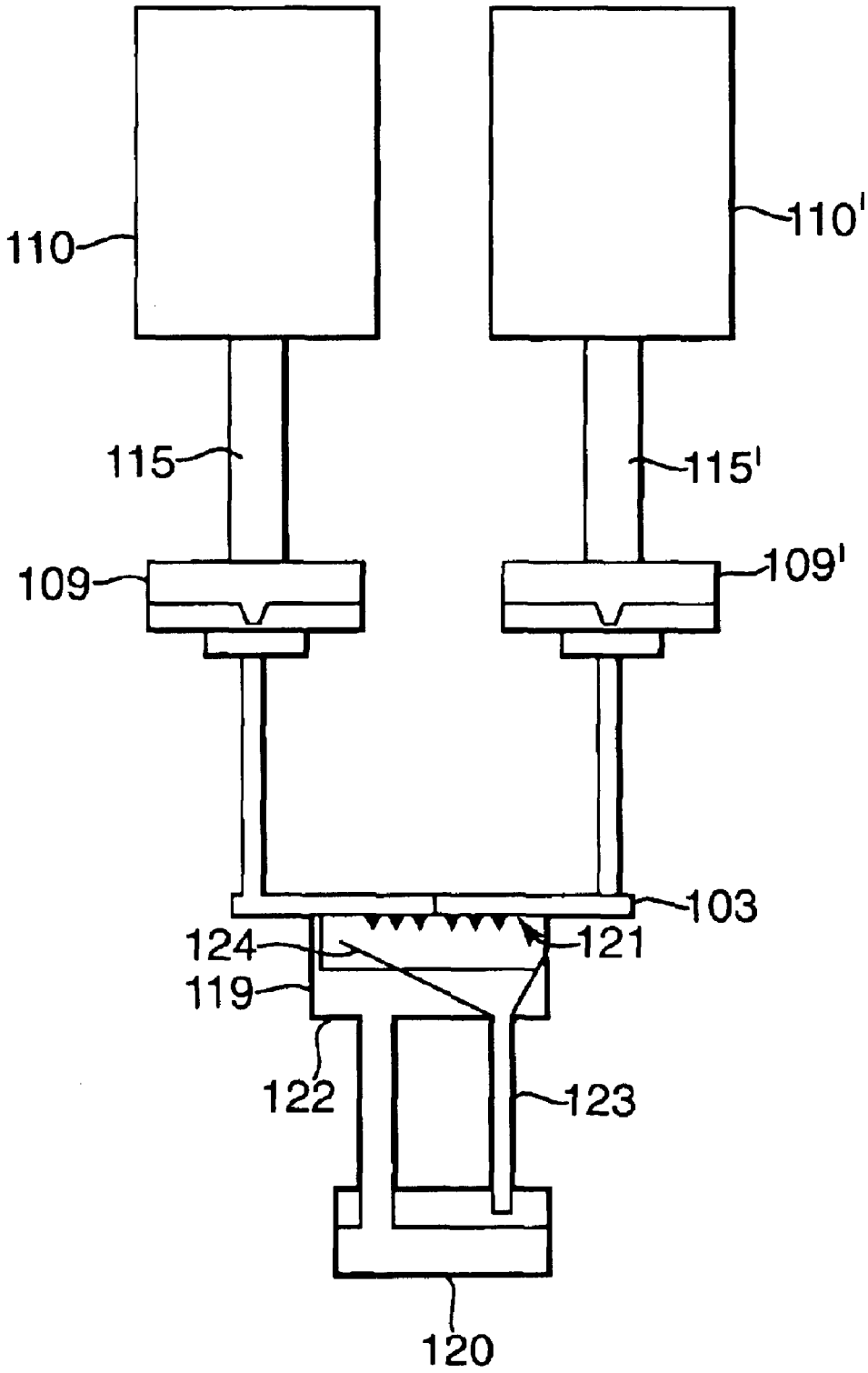
FIG. 8 is a sixth example showing the cooling of a dilution refrigeration device; and, FIG. 9 is an image of part of a practical device according to the fourth example.

FIG. 8 shows an example of this in which the lower region 103 of the two heat pipes 101,101' is connected. Again, as in FIG. 7 two single-shot adsorption refrigeration systems 110,110' are used along with corresponding evaporation chambers 109,109' and heat pipes 101,101'. However, rather than using the lower region 103 to directly cool experimental apparatus, in this case the combined lower region 103 is placed in thermal contact with an upper surface of a still chamber of a dilution refrigerator.

The still 119 and a mixing chamber 120 of the dilution refrigerator are indicated in FIG. 8. With this system, a cold platform is maintained at about 0.4 kelvin which is sufficient to cause condensation on an upper surface 121 of the still 119 such that the mixture 122 of helium-3 and helium-4 distill and present as the liquid within the still, can be distilled into helium-3. The helium-3 distillate is reintroduced into the mixing chamber via a conduit 123. A simple funnel device 124 is provided to collect the dripping helium-3 from the upper surface 121 of the still. The funnel 124 is connected to an upper end of the conduit 123 and the liquid helium-3 distillate is returned to the mixing chamber 120.

Figure 9:
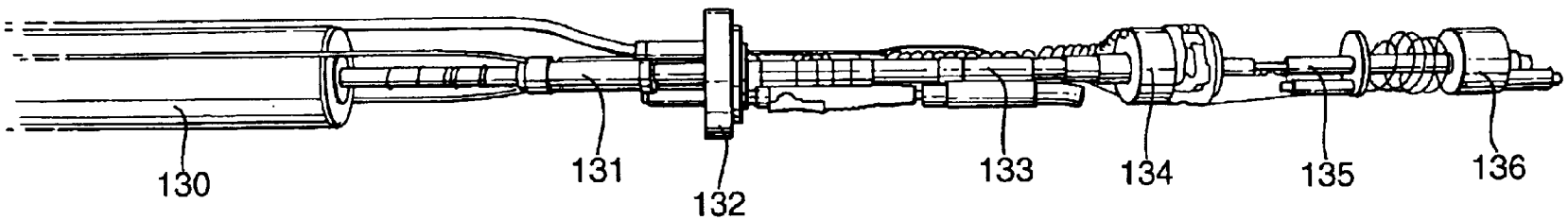

FIG. 9 shows a prototype apparatus according to this example. An adsorption pump is indicated at 130, at one end of the apparatus. A 4K heat exchanger 131 and an IVC flange 132 are also shown. Further along the apparatus a pumping line 133 and helium-3 pot 134 are provided, with the heat pipe being positioned at the opposite end of the apparatus with respect to the sorb 130. The upper 135 and lower 136 regions of the heat pipe are indicated in FIG. 6.

This apparatus is capable of attaining a temperature of 0.35 kelvin and has a cooling power of about 100 microwatts at 0.4 kelvin, that is a suitable temperature for providing helium-3 distillation in the still.

We claim:

1. A method of operating an adsorption refrigeration system, the system comprising an adsorption pump which, in use, is arranged in communication with a chamber containing liquid and gaseous coolant, the method comprising:

i) expanding the gaseous coolant into an auxiliary volume member so as to cause the removal of part of the gaseous coolant from the chamber, thereby reducing the temperature and pressure of the gaseous coolant in the chamber; and ii) operating the adsorption pump so as to further cool the chamber by causing the evaporation of the coolant liquid within the chamber.

2. A method according to claim 1, wherein step (i) further comprises expanding the gaseous coolant separately into a number of additional auxiliary volume members.

3. A method according to claim 1, further comprising, prior to the expansion step (i), supplying a quantity of the gaseous coolant to the adsorption refrigeration system, in excess of the saturation limit of the adsorbent material within the adsorption pump when operating under normal working conditions.

4. A method according to claim 3, wherein the gaseous coolant is supplied from an auxiliary volume member prior to step (i).

5. A method according to claim 3, wherein, prior to step (i), the temperature and pressure of the gaseous coolant in the chamber are about 4 Kelvin and 0.5 Bar respectively.

6. A method according to claim 3, wherein, during the initial supply of gaseous coolant, the adsorption pump is cooled such that the adsorption material contained therein adsorbs coolant gas so as to become substantially saturated.

7. A method according to claim 3, wherein following the initial supply of the gaseous coolant, the adsorption pump is heated so as to desorb coolant and thereby increase the pressure of the gaseous coolant in the chamber.

8. A method according to claim 7, wherein the adsorption pump is heated during step (i).

9. A method according to claim 7, wherein the adsorption pump is heated to about 100K whilst the chamber is maintained at a temperature of about 4K.

10. A method according to claim 1, wherein the expansion of the gaseous coolant during step (i) causes partial liquefaction of the coolant.

11. A method according to claim 10, wherein, prior to step (ii) the adsorption pump is cooled thereby further reducing the pressure of the gaseous coolant within the chamber.

12. A method according to claim 11, wherein the reduction of the gaseous coolant pressure due to the cooling of the adsorption pump causes partial liquefaction of the coolant.

13. A method according to claim 1, wherein during the or each step (i) the gaseous coolant is expanded into a storage reservoir.

14. A method according to claim 1, wherein the gaseous coolant is expanded into a second adsorption pump.

15. A method according to claim 1, wherein during step (i) the volume and/or temperature of the auxiliary volume member is varied.

16. A method according to claim 1, wherein the capacity of the auxiliary volume member is greater than the gas adsorption capacity of the adsorption pump.

17. A method according to claim 1, wherein the expansion of the coolant gases into the auxiliary volume is controlled using a valve.

18. A method according to claim 1, wherein the communication of the adsorption pumps and chamber is controlled using a valve.

19. A method according to claim 1, wherein the adsorption pump and chamber are isolated from the auxiliary volume member during step (ii).

20. A method according claim 1, wherein the coolant comprises any of helium-3, helium-4, nitrogen, hydrogen, or neon.

21. A method according to claim 1, wherein the expansion of the gaseous coolant during the or each step (i) is substantially adiabatic.

* * * * *